United States Patent [19]

Lee

[11] Patent Number: 4,852,726

[45] Date of Patent: Aug. 1, 1989

[54] MULTIPLE WATER COLOR COMBINATION SET

[76] Inventor: Genius Lee, No. 25, Lane 380, Sec. 2, Chung-Shan Road, Chung-Ho City, Taipei Hsjen, Taiwan

[21] Appl. No.: 285,609

[22] Filed: Dec. 15, 1988

[51] Int. Cl.[4] ..... B05C 17/00; B44D 3/00

[52] U.S. Cl. ..... 206/1.9; 220/23.4; 220/4 R; 220/288

[58] Field of Search ..... 206/1.9, 1.7, 575; 220/23.4, 4 R, 288

[56] References Cited

U.S. PATENT DOCUMENTS

| | | | |
|---|---|---|---|
| 380,894 | 4/1888 | Homza | 206/1.9 |
| 440,507 | 11/1890 | Sanders | 206/1.9 |
| 1,650,967 | 11/1927 | Smith | 206/1.9 |
| 3,876,112 | 4/1975 | Kramer | 220/23.4 |
| 4,133,445 | 1/1979 | Handelbaum | 220/23.4 |

*Primary Examiner*—Joseph Man-Fu Moy

*Attorney, Agent, or Firm*—Lowe, Price, LeBlanc, Becker & Shur

[57] ABSTRACT

A multiple water color combination set comprised of a plurality of flexible plastic tubes connected by means of connecting means made on each plastic tube, letting a socket cap be heat sealed with the flexible plastic tubes to form an integral unit immediately after said flexible plastic tubes being well filled with respective color pigment.

3 Claims, 4 Drawing Sheets

MULTIPLE WATER COLOR COMBINATION SET

BACKGROUND OF THE INVENTION

Common manufacturing of water color is filling in a soft tube with one water color material, however after the introduction of the machinery into the manufacturing process, filling is still one color material into a singular tube anywhere in the world after hundred years. In view of the time consuming and high cost of the above-mentioned process, the inventor invented a multiple tube for water color.

This invention relates to a multiple tube for water color having the following advantages; multiple tube filling in one filling action; cost reduction in manufacturing process; compact package and space saving in packing and shipment; easy usage of many colors; smart look and practical.

SUMMARY OF THE INVENTION

The invention therefore contemplates a multiple tube for water color having a plurality of plastic tube joined together for color material filling and plastic tube with many cavities having internal screw thread to connect with its base and then bonded by heat sealing after color material filling. It is characterized by a single process to fill a number of color material and by easiness of using.

The above-mentioned and other features of the present invention will now be made by way of examples, reference being made to the accompanying drawings as hereunder.

DESCRIPTION OF THE PREFERRED EMBODIMENTS

Figure 1:
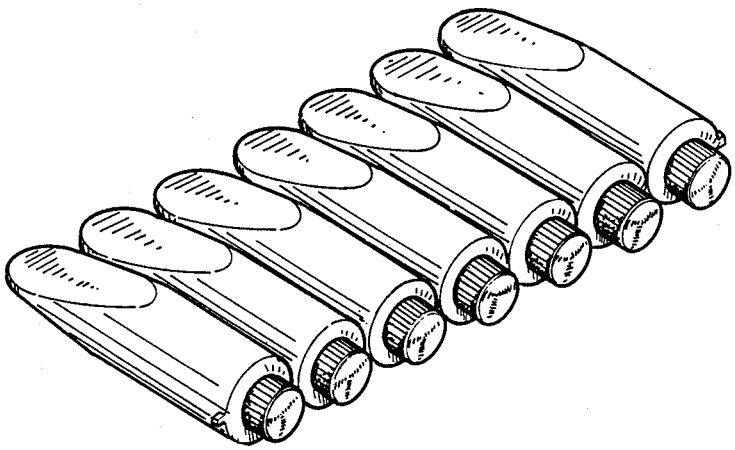
FIG. 1 is a perspective drawing of a preferred embodiment according to the present invention.
Figure 2:
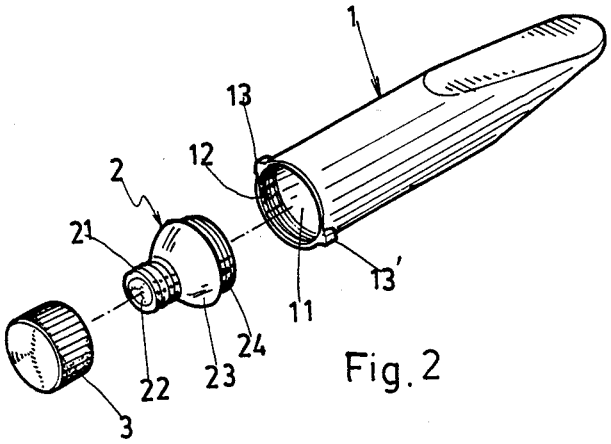
FIG. 2 is a fragmented drawing of a single tube of the said embodiment.

Referring to FIG. 1 and 2, the embodiment constructed according to the present invention includes a flexible tube body (1), a socket cap (2) and a top cap (3). Said flexible plastic tube (1) comprises a cavity (11) for filling of color material, an inner thread (12) made on the top of said cavity. Said socket cap (2) includes a shoulder portion (23) comprising a base seat (24) made at the bottom having an outer thread made on said base seat (24) for connection with said inner thread (11) of said flexible tube body (1). After connection, said socket cap (2) and said flexible plastic tube are heat sealed through high frequency sealing process to form an integral unit. Said socket cap (2) comprises a diaphragm (22) made on the top. When the said diaphragm is pierced, the color material contained in said flexible tube body (1) is squeezed out for service. Through the arrangement of said diaphragm, one can easily identify which end of the embodiment is the head portion. Further, the said socket cap (2) has an outer thread (21) made on its head portion for connection with a cap (3) by means of screw joint, to prevent from leaking of internal color material.

Figure 3:
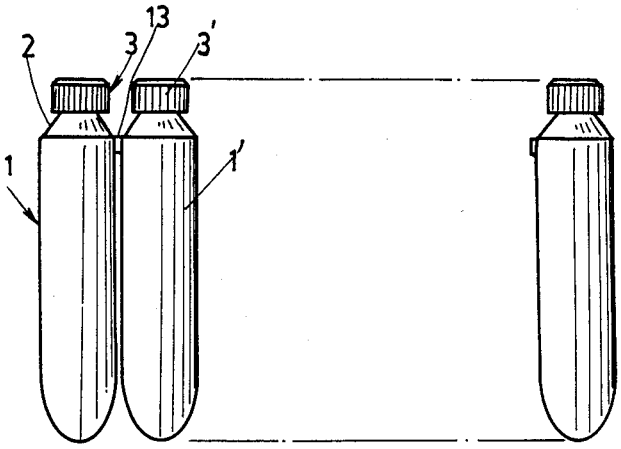
FIG. 3 is a plan view drawing of the said embodiment.

The said flexible plastic tube body (1) comprises retainer noses (13) and (13') for connection with the retainer noses of other flexible plastic tubes of same structure. As shown in FIG. 3, two or more flexible plastic tubes (1), (1') are conjugated into an integral multiple water color combination set by means of adhesive connection or high frequency heat sealing process, or by means of injection molding process to let several pieces of the embodiments be integrally produced.

Figure 5:
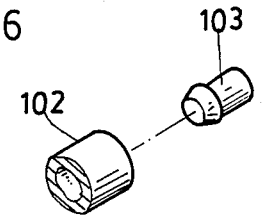
FIG. 5 is a plan drawing showing the structure of cap and outlet of the said embodiment.
Figure 4:
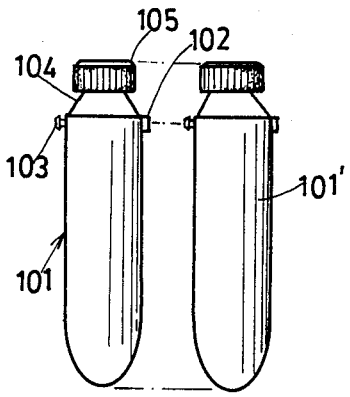
FIG. 4 is a plan view drawing of the said embodiment.

Referring to FIG. 4 and 5, a flexible plastic tube (101) comprises a socket (102), a socket pin (103), a socket cap (104) and a top cap (105), wherein said socket cap (104) and said top cap (105) have same structure as the above-described embodiment. A plurality of flexible plastic tube (101), (101') may be connected together by means of the connection of the socket (102) of one flexible plastic tube with the socket pin (103) of another flexible plastic tube, so as to form a combination set for filling of diversified color material. (104) and cap (105), the angle part (104) can be joined with the pin (103') of the other tube (101') forming multiple tube which can be filled in single filling.

Figure 6:
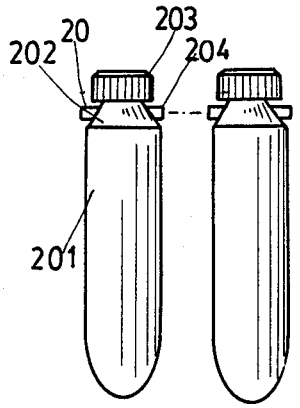
FIG. 6 is another plain drawing of the said embodiment.

Referring to FIG. 6, the embodiment is for filling of color material from rear end. The socket cap (202) comprises a linking block (204), such that a plurality of flexible plastic tubes (201) may be connected together by means of adhesive or high frequency heat sealing process to form a combination set for filling of diversified color material.

Figure 7:
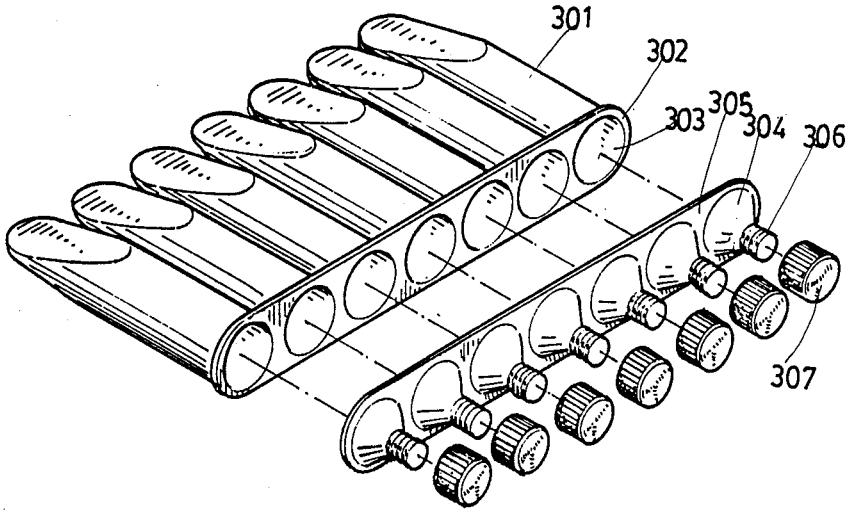
FIG. 7 is another fragmented drawing of the said embodiment.

Referring to FIG. 7, a plurality of flexible plastic tube (301) are connected together by means of a connecting plate (302) to form a combination tube set having cavities (303) for filling of color material. After filling, the combination tube set is further covered by a plurality of socket caps (304) via a connecting plate (305), wherein said socket caps (304) each comprises an outer thread (306) for connection of respective top cap (307) by means of screw joint.

In general, the present invention is to provide a water color combination set comprised of a plurality of tubes connected together by means of proper fastening means for filling of diversified color material for better performance.

I claim:

1. A multiple water color combination set of which the structure includes:

a flexible plastic tube having cavity made therein for filling of color pigment, having inner thread made at the top of said cavity, and having retainer nose made at appropriate position;

a socket cap comprised of shoulder portion, base seat, and head portion, said head portion comprising an outer thread and having a diaphragm made on the top, said base seat being connected to said shoulder portion at the bottom and being arranged to provide outer thread;

by means of said component parts to let a fixed number of flexible plastic tubes be conjugated together and be filled with color pigment and to let the conjugate and pigment-filled tubes be block up by said socket cap and to let the conjugated tubes and socket cap be processed by high frequency heat sealing procedure to form an integral unit.

2. A multiple water color combination set according to claim 1 wherein the joining of the flexible plastic tubes is achieved by means of adhesive connection or by means of high frequency heat sealing process to let the flanges of the flexible plastic tubes be fused or, by means of injection molding process to let several flexible plastic tubes be integrally made into one unit or, by means of a socket cap portion to connect a plurality of flexible plastic tubes into one unit.

3. A multiple water color combination set according to claim 1 wherein said flexible plastic tube is filled with color pigment from the bottom, comprising a connecting means made on the shoulder portion or tubular body to let a plurality of flexible plastic tubes be connected into one unit by means of set-in joint or shape-forming process.

* * * * *